US005234118A

United States Patent [19]

Fillmore et al.

[11] Patent Number: 5,234,118

[45] Date of Patent: Aug. 10, 1993

[54] CHILD RESISTANT CLOSURE

[75] Inventors: William E. Fillmore, Toledo; Maximillian Kusz, Waterville, both of Ohio

[73] Assignee: Owens-Illinois Closure Inc., Toledo, Ohio

[21] Appl. No.: 947,208

[22] Filed: Sep. 18, 1992

[51] Int. Cl.[5] ..... B65D 55/02

[52] U.S. Cl. ..... 215/220; 215/206; 215/223

[58] Field of Search ..... 215/203, 206, 214, 217, 215/219, 220, 223, 230

[56] References Cited

U.S. PATENT DOCUMENTS

| | | | |
|---|---|---|---|
| 3,306,482 | 2/1967 | Tuuri | 215/220 |
| 3,338,444 | 8/1967 | Velt | 215/220 |
| 3,472,411 | 10/1969 | Turner | 215/220 |
| 3,625,387 | 12/1971 | Schaefer | 215/215 |
| 3,705,662 | 12/1972 | Gach | 215/220 |
| 3,710,970 | 1/1973 | Elfline | 215/219 X |
| 3,774,794 | 11/1973 | Bateman | 215/220 |
| 4,020,965 | 5/1977 | Northup | 215/213 |
| 4,223,794 | 9/1980 | Morris | 215/220 |
| 4,281,771 | 8/1981 | Siegel | 215/220 |
| 4,285,437 | 8/1981 | Morris | 215/220 |
| 4,353,473 | 10/1982 | Morris | 215/220 |
| 4,555,036 | 11/1985 | Bekkers et al. | 215/220 |
| 4,588,098 | 5/1986 | Uzdy | 215/230 |
| 4,854,459 | 8/1989 | De Jonge | 215/220 |
| 5,115,928 | 5/1992 | Drummond, Jr. | 215/219 |
| 5,158,194 | 10/1992 | Sirgo et al. | 215/219 |
| 5,170,900 | 12/1992 | Manera | 215/218 |

*Primary Examiner*—Allan N. Shoap
*Assistant Examiner*—Stephen Cronin

[57] ABSTRACT

A child resistant closure which can be readily opened by an adult comprising an outer closure member having a base wall, a peripheral skirt and a bead on the outer closure member for retaining an inner closure member for limited axially outward movement relative to the outer closure member. A push tab is hinged to the base wall of the outer closure member and projects through an opening in the base wall of the outer closure member. The push tab can be depressed into a plurality of spaces provided between circumferentially spaced ramp-type projections or castellations on the inner closure member. One of the castellations is provided with a stop surface such that when the push tab is depressed in that location, as indicated by indicia on the outer closure member and inner closure member, the closure can be unthreaded from a container to remove the closure. Further, the outer closure member can also be removed by axial movement of the outer closure member relative to the inner closure member to engage ribs and additional projections on the respective outer closure member and inner closure member so that the closure can be rotated to unthread it from a container.

11 Claims, 4 Drawing Sheets

CHILD RESISTANT CLOSURE

This invention relates to child resistant closures and particularly to child resistant closures which provide child resistance but are readily opened by adults.

BACKGROUND AND SUMMARY OF THE INVENTION

Child resistant closures of the push tab type are old and well known as shown, for example, in U.S. Pat. Nos. 3,338,444, 3,625,387, 3,705,662, 3,710,970, 3,774,794, 4,285,437, 4,353,473 and 4,555,036.

Among the objectives of the present invention are to provide a child resistant closure member which is child resistant and readily opened by adults; which can be readily manufactured by simple molds as contrasted to complex molds of limited durability; which is relatively simple in construction and manufacture; which incorporates conventional axially engageable child resistant construction; and which may be removed in one of two modes either by use of a push tab and rotation or by use of axial force and rotation.

In accordance with the invention, a child resistant closure which can be readily opened by an adult comprises an outer closure member having a base wall and a peripheral skirt, an inner closure member having a base wall, a peripheral skirt and a bead on the outer member for retaining the inner closure member for limited axially outward movement relative to an outer closure member. A push tab is hinged to the base wall of the outer closure member and projects through an opening in the base wall of the outer closure member. The push tab can be depressed into a plurality of spaces provided between circumferentially spaced ramp-type projections or castellations on the inner closure member. One of the castellations is provided with a stop surface such that when the push tab is depressed in that location, as indicated by indicia on the outer closure member and inner closure member, the closure can be unthreaded from a container to remove the closure. The outer closure member can also be removed by axial movement of the outer closure member relative to the inner closure member to engage ribs and additional projections on the respective outer closure member and inner closure member so that the closure can be rotated to unthread it from a container.

DESCRIPTION

Figure 1:
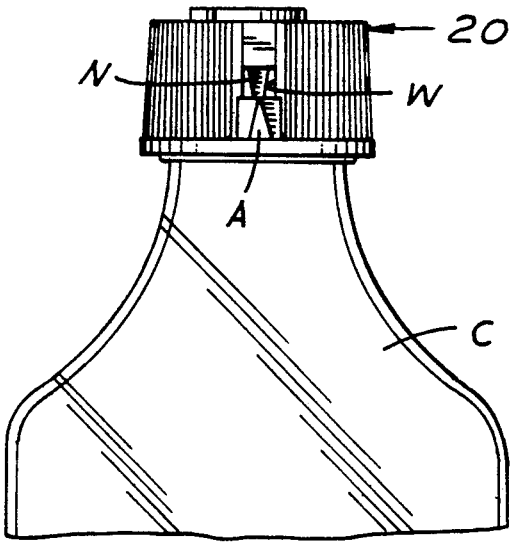
FIG. 1 is a fragmentary elevational view of a child resistant closure embodying the invention applied to a container.
Figure 2:
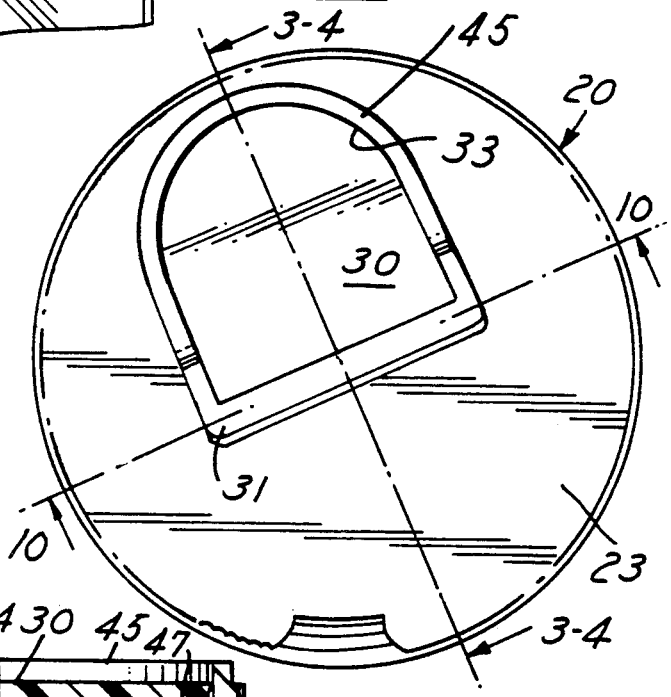
FIG. 2 is a plan view of the closure on an enlarged scale.
Figure 3:
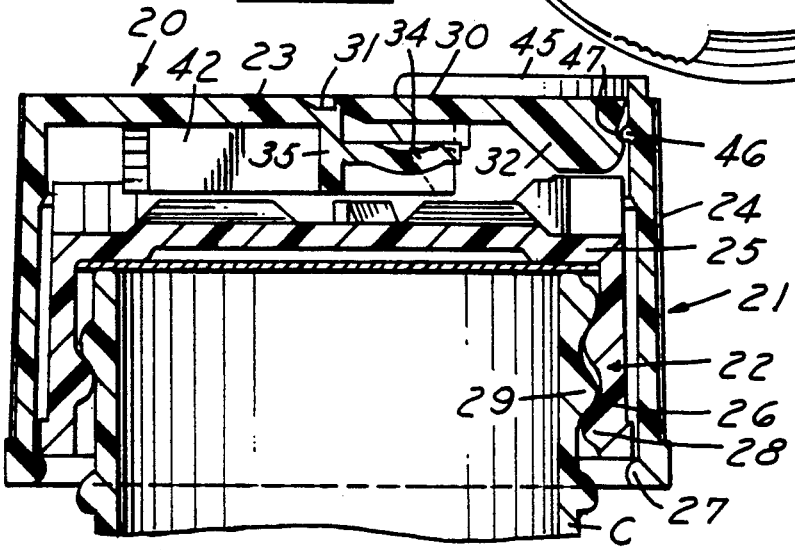
FIG. 3 is a fragmentary sectional view taken along the line 3—3 in FIG. 2 showing the closure applied to a container.

Referring to FIGS. 1–7, the child resistant closure which can be readily removed by adults and made in accordance with the invention comprises a closure 20 that is adapted to be threaded on a container C of glass or plastic. The closure 20 includes an outer closure member 21 and an inner closure member 22 (FIG. 3). Outer closure member 21 includes a base wall 23 and a peripheral skirt 24. Inner closure member 22 includes a base wall 25 and a peripheral skirt 26.

The outer closure member 21 and the inner closure member 22 are made of plastic material and preferably polypropylene.

Figure 4:
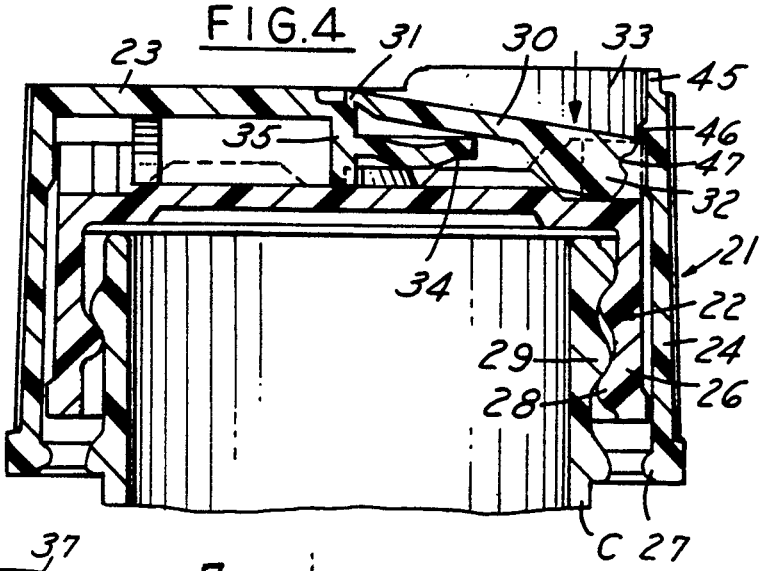
FIG. 4 is a fragmentary view taken along the line 4—4 in FIG. 2 showing the push tab depressed.

As shown in FIGS. 3 and 4, an annular retaining bead 27 on the inner surface of the skirt 24 of the outer closure member 21 is operable to permit limited axial movement of the outer closure member 21 relative to the inner closure member 22. The skirt 26 of the inner closure member 22 includes threads 28 adapted to engage threads 29 on the container C.

Referring to FIGS. 2–4 and 5, the outer closure member 21 includes a push tab 30 that is hinged by an integral hinge 31 to the base wall 23 of the outer closure member and has a lug 32 extending axially downwardly therefrom. The push tab 30 extends through an opening 33 in the base wall 23 and has its downward movement limited by laterally extending flange 34 that extends from an axial wall 35 on the underside of the base wall 23.

Figure 5:
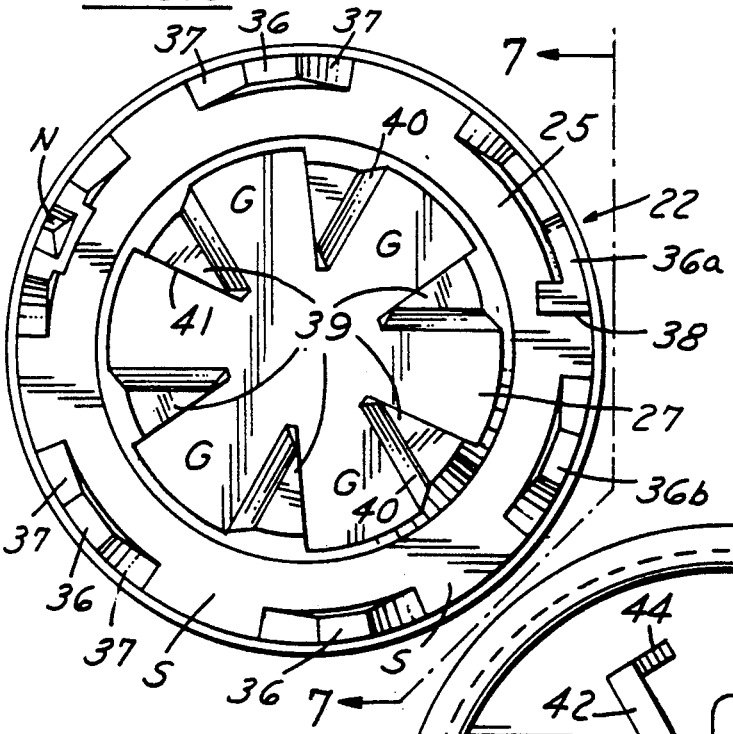
FIG. 5 is a top plan view of the inner closure member of the closure.

As shown in FIG. 5, the inner closure member 22 is provided with a plurality of circumferentially spaced ramp-type projections or castellations 36 extending axially from the base wall 25 about the periphery of the base wall 25. The projections 36 extend generally circumferentially and each has an inclined ramp 37 at each end thereof and thus forming spaces S between the projections 36. One projection **36*a* is formed with a vertical or axial face 38. The axial height of this portion of projection 36*a*, as well as the axial height of the adjacent projection 36*b* is greater than the height of the remaining projections 36**.

The inner closure member 22 further includes a plurality of circumferentially spaced generally radial, pie-shaped lugs 39 aligned generally with projections 36, **36*a*, 36*b*. Each pie-shaped lug 39 includes a sloped side surface 40 and a vertical or axial side surface 41 (FIG. 5**).

Figure 6:
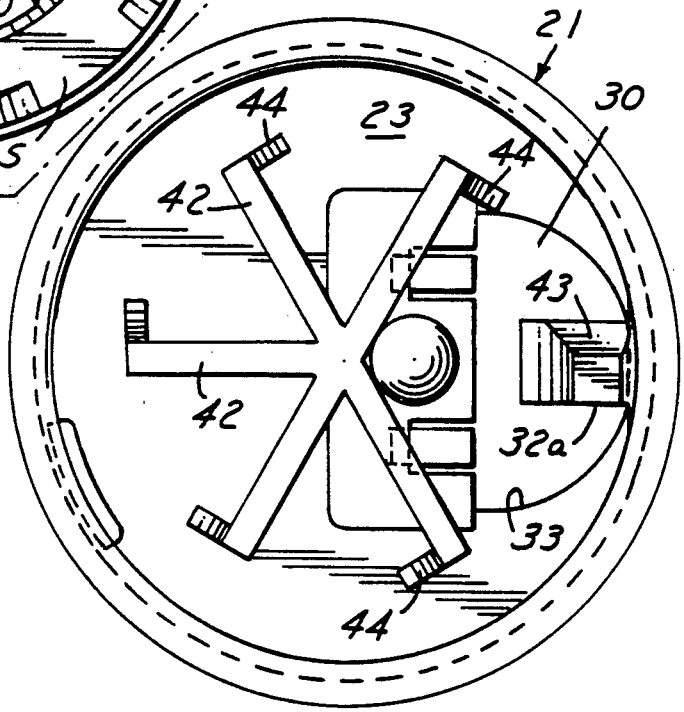
FIG. 6 is a bottom plan view of the outer closure member of the closure.

The underside of the base wall 23 of the outer closure member 21 is formed with a plurality of circumferentially spaced radial ribs 42, joined at their ends for strength, one rib 42 being provided for each of the radial pie-shaped lugs 39 except for the area of the base wall which includes the opening 33 (FIG. 6). Each rib 42 has integral means thereon for rigidifying the rib 42 relative to the outer closure member 21 comprising an integral portion 44 at its radially outer end, which portion extends between the rib 42 and the base wall 23.

The outer closure member 21 further includes an arcuate axial wall 45 that extends upwardly from the base wall 23 (FIGS. 2,4) and circumscribes the major portion of the push tab 30. The inner surface of the skirt 24 of the outer closure member 21 includes a bead 46 that in one position as shown in FIG. 3 engages a groove 46*a* in the push tab 30 and in another position engages the upper surface of the push tab 30 as shown in FIG. 4.

Figure 7:
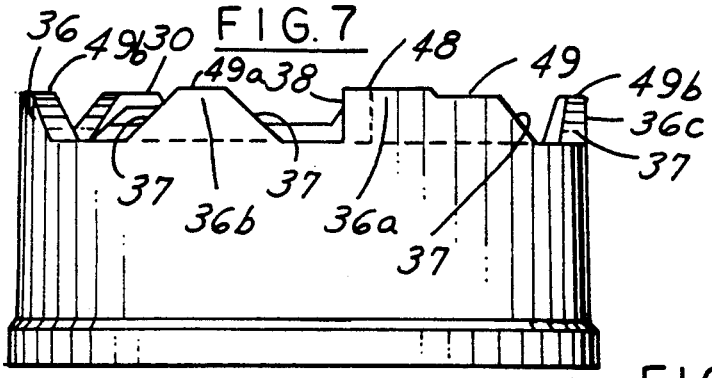
FIG. 7 is a view taken along the line 7—7 in FIG. 5.
Figure 8:
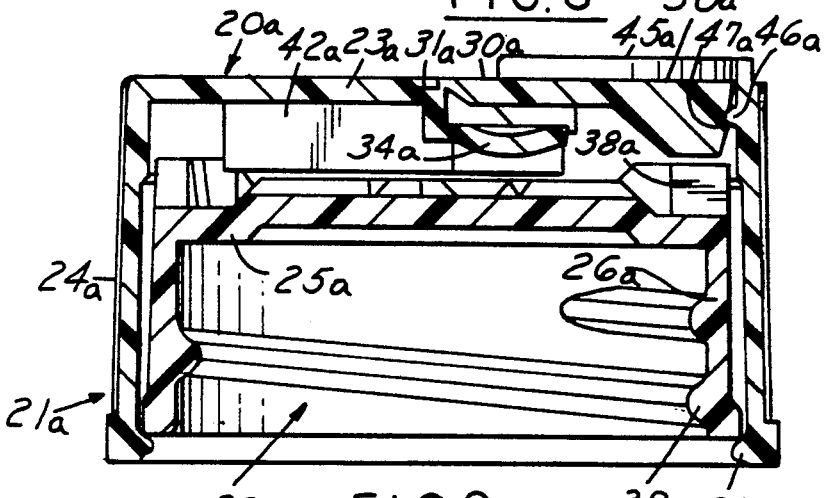
FIG. 8 is a sectional view of a modified form of closure.
Figure 9:
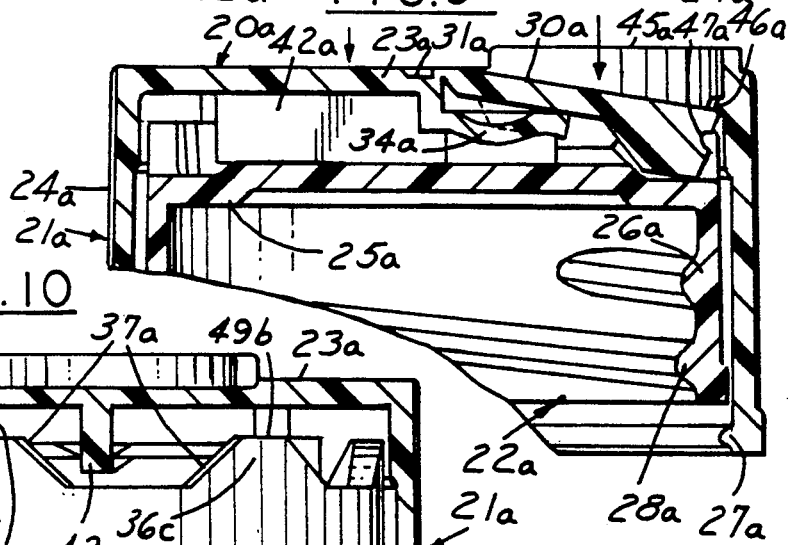
FIG. 9 is a fragmentary sectional view of the modified form of closure shown in FIG. 8 in a different operative position.
Figure 10:
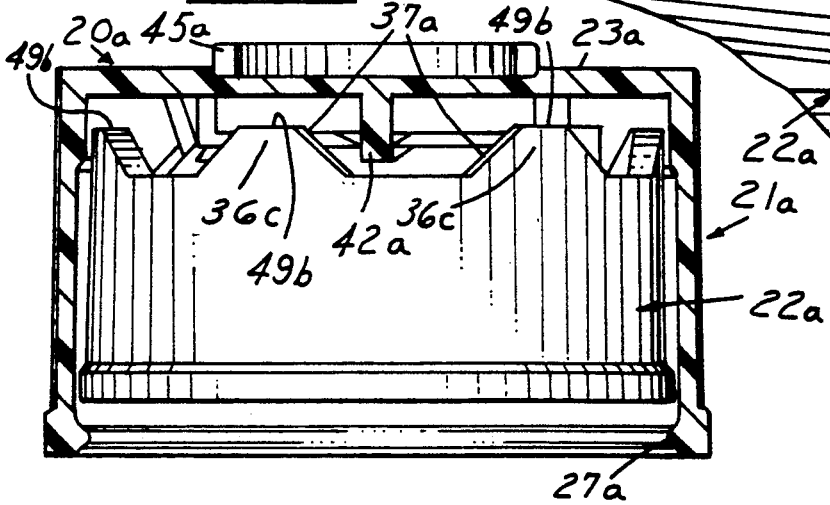
FIG. 10 is a view taken along the line 10—10 in FIG. 2.
Figure 11:
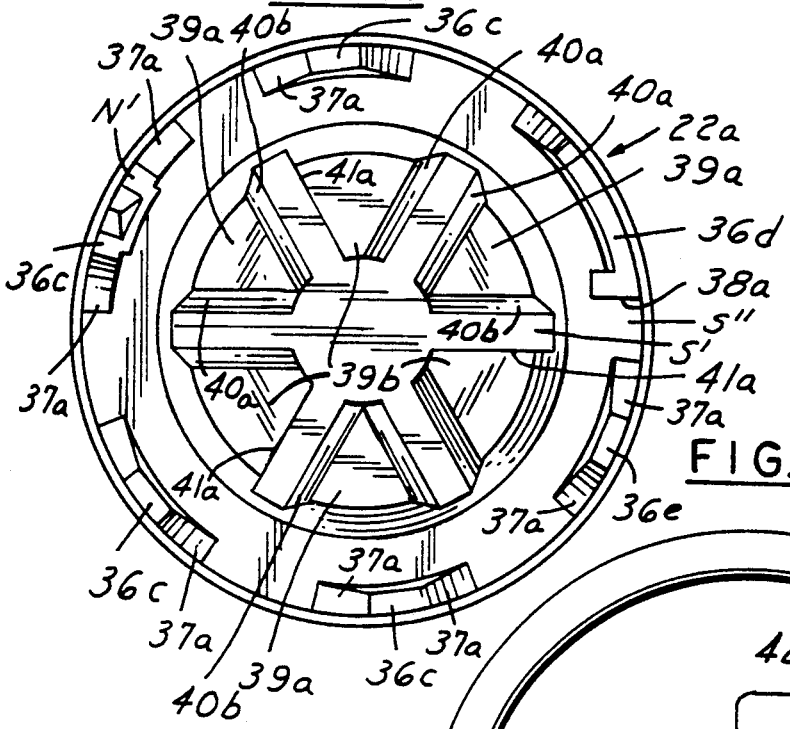
FIG. 11 is a top plan view of the inner closure member shown in FIGS. 8–10.

As shown in FIG. 7, the projection 36*a* having the vertical or axial surface 38 thereon includes a portion 48 having an upper surface with a greater axial height than a portion 49. The adjacent projection 36*b* has a portion 49*a* with an upper surface that has the same axial height as portion 48 of projection 36*a*. The portion 49 of projection 36*a* has the same axial height as the upper surfaces 46*b* of the remaining projections 36.

The two components or closure members 21, 22, when assembled, form a child resistant closure 20 which can be easily applied to a container C by means of the screw thread system. Positive application torque is transmitted by means of five radial ribs 42 within the outer closure member 21 which make intimate contact with vertical surfaces 41 of the pie-shaped radial lugs 39 of the inner closure member 22.

A window W is provided in the skirt 24 of the outer closure member 21 with indicia such as a projecting arrowhead A located thereunder. A V-shaped notch N has been placed strategically on the skirt 26 of inner closure member 22. When the V-shaped notch N has been oriented with the window W and the arrowhead A of the outer closure member 21, the two components will be aligned for removal. Then, when the push tab 30 is pushed downward, the lug 32 will be located adjacent the vertical stop face 38 of the inner closure member 22 so that a vertical face 32*a* on the lug 32 is adjacent the vertical face 38. The closure can be readily removed by counterclockwise motion to bring the vertical face 32*a* into contact with the vertical face 38 so that continued rotation of the outer closure member 21 will rotate the inner closure member 22 and unthread the closure from the container.

The push tab 30 may be depressed in five other locations. When this is done, and the outer closure member 21 is rotated counterclockwise, a radial rib 42 on the outer closure member 21 will engage and be lifted by the sloping sides 40 of the radial pie-shaped lugs 39 of the inner closure member 21. Further rotation will cause the push tab 30 to cam upward to normal position as the bottom lug 32 of the push tab 30 contacts the ramp surface 37 of a projection 36 or 36*b*. Clockwise rotation of the outer closure member 21 will cause the ramps 37 of the projections 36, 36*a* or 36*b* to elevate the depressed push tab 30 by engagement of the sloping surface 43 of the lug 32.

The closure may also be removed by pushing the outer closure member 21 down firmly while rotating it counterclockwise, in the normal child resistant manner. In such a mode, axial movement and counterclockwise rotation of the outer closure member 21 relative to the inner closure member 22 will bring the ribs 42 into the spaces G between the pie-shaped lugs 39 and cause the ribs 42 to engage the sloping surfaces 40 of the pie-shaped lugs 39. Further rotation of the outer closure member 21 with sufficient axial force to prevent the ribs 42 from camming upward will cause the inner closure member 22 to be unthreaded from the container.

It is desirable to have the tab 30 revert to its original position during application to the closure. This is in fact accomplished by using the sloped surfaces 37 on the projection 36*b* in contact with the inclined side surface 43 of tab abutment 32. The surfaces 37, 43 come into contact when the outer closure 21 is rotated in the clockwise (application direction) before the radial ribs 42 contact the side surfaces 41 of the pie-shaped lugs 39. This contact between the sloped surfaces 37 and the side surface 43 causes the tab 30 to be cammed upwardly as the closure is rotated in the application (CW) direction. Continued rotation causes contact between the radial ribs 42 and side surfaces 41 of the pie-shaped lugs 39, which results in the inner closure member 22 being threaded onto the container finish.

Figure 12:
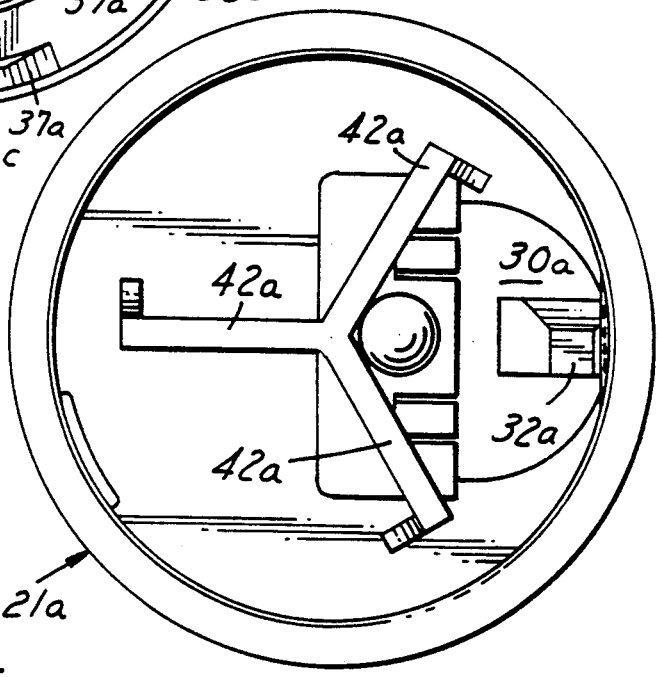
FIG. 12 is a bottom plan view of the outer closure member shown in FIGS. 8–10.
Figure 13:
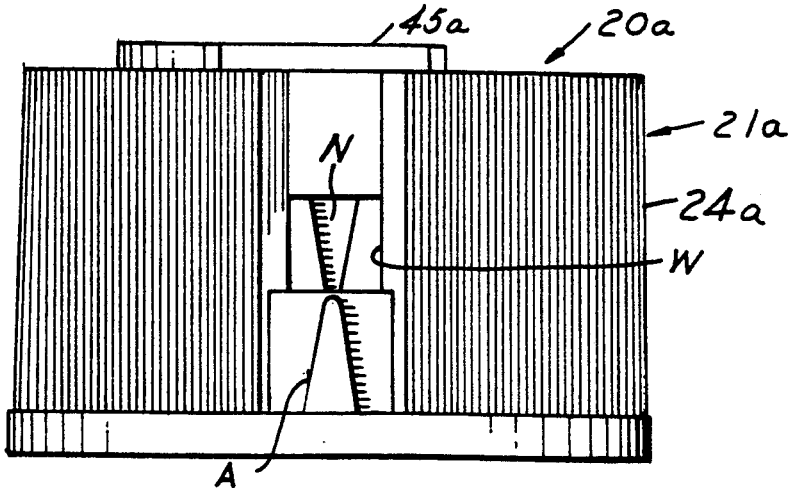
FIG. 13 is an elevational view of the closure shown in FIGS. 8–10.

As shown in the form shown in FIGS. 8–13, the inner closure member 22*a* includes axial projections or castellations 36*c* of equal height as in the form shown in FIGS. 1–7. However, in this form, the circumferentially spaced pie-shaped lugs 39*a* and 39*b* on the upper surface of the base wall 25*a* of the inner closure member 22*a* had a wider angular extent. Also in this form three ribs 42*a* are provided on the outer closure member 21*a* as shown in FIG. 12. The pie-shaped lugs 39*a*, 39*b* are circumferentially spaced. Lugs 39*a* have sloping surfaces 40*a* along their sides. Lugs 39*b* have a vertical face 41*a* and a sloping face 40*b*. The lugs 39*a*, 39*b* are oriented such that a space S′ between a lug 39*a* and a lug 39*b* is aligned with the space S″ between the projection 36*d* having a vertical face 38*a* and the adjacent projection 36*e*.

The two components, when assembled, form a child resistant closure which can be easily applied to a container by means of the screw thread system. Positive application torque is transmitted by means of the three radial ribs 42*a* within the outer closure member 21*a* which make intimate contact with vertical surfaces 41*a* of the lugs 39*b* of the inner closure member 22*a*. Only three of the radial pie-shaped lugs 39*b* have vertical surfaces 41*a*. This is to assure that the closure will not be applied with the push tab 30*a* in "removal" position.

It is desirable to have the tab 30*a* revert to its original position during application of the closure. This is accomplished by using the sloped surfaces 40*a* or 40*b* on pie-shaped lugs 39*a* in contact with radial ribs 42*a* of the outer closure member 21*a* which contact each other during application (clockwise) rotation of the outer closure member 21*a*. The radial ribs 42*a* cam up sloped surfaces 40*a* and past pie-shaped lugs 39*a*. During this rotation, lug 32*a* engages the sloped surface of 37*a* of projection 36*e* and is cammed upwardly to its original position. The radial ribs 42*a* can now contact the vertical sides 41*a* of pie-shaped lugs 39*b*, and with continued rotation of the outer closure this contact causes the inner closure to be rotated in a CW direction and be threaded into the container finish.

As in the previous form, this form can be removed in one of two modes, namely, by utilizing the push tab or by utilizing the relative axial movement between the outer closure member and inner closure member.

It is noted that the lugs 36, 36*a*, 36*b*, 36*c*, 36*d* and 36*e* are not of equal circumferential length.

It can thus be seen that in each of the forms of the invention, the closure can be removed in one or two modes, namely, a first mode utilizing a push tab and rotation and a second mode requiring relative axial force and rotation.

We claim:

1. A child resistant closure that can readily be operated by an adult in one of two modes comprising an outer closure member having a base wall and a peripheral skirt, an inner closure member having a base wall and a peripheral skirt., interengaging means between the outer closure member and inner closure member limiting the axial movement of the members away from one another but permitting axial movement toward one another, a push-tab hinged to the base wall of the outer closure member and extending through an opening in the base wall of the outer closure member and having an axial lug extending from a bottom surface of the tab, at least one projection on the upper surface of said base wall of said inner closure member, at least one lug on said base wall of said inner closure member, at least one rib on an undersurface of said base wall of said outer closure member and stationary with respect to the base wall, visual indicia on said outer and inner closure members which when oriented bring said axial lug on the push tab in alignment with said projection, such that the closure can be removed from a container in a first mode by depressing said push tab to engage said axial lug with said at least one projection and such that said closure can be removed from a container in a second mode by application of axial force and rotation to engage said at least one rib on the outer closure member with said at least one lug on said inner closure member.

2. The child resistant closure set forth in claim 1 including means between said outer closure member and said inner closure member operable to cam said push tab upwardly to non-use position in the event said push tab is in the depressed position and the outer closure member is rotated when said indicia are not oriented.

3. The child resistant closure set forth in claim 2 wherein said at least one projection comprises a plurality of circumferentially spaced projections are provided on the upper surface of the base wall of the inner closure member thereby defining a plurality of spaces between said projections, each said projection having outwardly and oppositely facing inclined circumferentially extending ramps except for one of the projections which has an axial surface in place of one of said ramps, said at least one lug comprises a plurality of having circumferentially spaced lugs thereon, said lugs having an axial surface thereon and an inclined surface thereon, said at least one rib comprises a plurality of circumferentially spaced ribs extending from the undersurface thereof and adapted to engage the plurality of lugs on said inner closure member when the outer closure member is moved axially toward said inner closure member and rotated, such that the closure can be readily removed in a first mode when the axial lug on the tab and the axial surface on the one projection are engaged and such that when the indicia are not oriented, depression of the push-tab results in causing the radial ribs of the outer closure member to be lifted by the inclined surfaces of the sides of the projections on the inner closure member in all other positions when the outer closure member is rotated in the direction to unthread the closure from the container thereby camming the push-tab upwardly to the non-use position as the lug contacts the ramp surface of one of said projections and such that rotation of the outer closure member in the direction for threading the closure on a container will cause the push-tab to be cammed upwardly by the sloping surfaces on the projections on the inner closure member, such that the closure can be removed in a second mode by application of axial force and rotation to engage the plurality of ribs on the outer closure member with the inclined surfaces of the lungs on the inner closure member, and such that the closure can be applied by engagement of the plurality ribs on the outer closure member with the axial surfaces of the plurality of lugs on the inner closure member.

4. The child resistant closure set forth in claim 3 wherein the a plurality of lugs on the inner closure member are inwardly and radially adjacent the plurality of projections on the inner closure member in a direction for application of the lugs having a greater height than the projections such that in the vent the push-tab is depressed upon application of the closure, the push-tab is cammed upwardly by engagement between the axial lug on the push-tab and the inclined ramp of the projection before the ribs on the outer closure member contact the lugs on the inner closure members to thread the inner closure member on a container.

5. The child resistant closure member set forth in claim 2 wherein the at least one lug on the inner closure member has an axial surface the at least one lug being inwardly and radially adjacent the at least one projection and having have a greater height than the at least one projections such that in the event the push-tab is depressed upon application of the closure, the push-tab is cammed upwardly by engagement between the axial lug on the push-tab and the inclined ramp of the at least one projection before the at least one rib on the outer closure member contact the at least one lug on the inner closure members to thread the inner closure member on a container.

6. The child resistant closure set forth in claim 2 wherein said at least one lug on the inner closure member comprises a plurality of lugs in alternating sets, one set having oppositely facing inclined surfaces and the other set having an inclined surface and an oppositely facing axial surface, the height of the lugs on the inner closure member being substantially the same height, said at least one rib comprising a plurality of ribs, said at least one projection comprising a plurality of projections, said projections having oppositely facing inclined ramps except for one of said projections which has an axial surface in place of one of said ramps, so that in the event the push-tab is depressed upon application of the closure, the axial lug on the push tab will successively engage the inclined ramps of the projections on the inner closure member camming said push tab upwardly to a non-use position as the outer closure member is rotated and the outer closure member will move axially relative to the inner closure member until the ribs on the outer closure member engage the axial surfaces of the lugs on the inner closure member to thread the inner closure member onto the container.

7. The child resistant closure set forth in claim 2 wherein said outer closure member includes an axial wall circumscribing a peripheral portion of the push-tab.

8. The child resistant closure set forth in any one of claims 1–7 wherein said indicia comprise an opening on a peripheral skirt of said outer closure member, said inner closure member having indicia on the peripheral skirt thereof viewable through said opening when the push-tab is aligned for engagement with the axial surface of the projection having the axial surface.

9. The child resistant closure set forth in claim 2 wherein said at least one rib extends radially.

10. The child resistant closure set forth in claim 9 wherein said indicia includes a V-shaped notch on the peripheral skirt of said inner closure member and an arrowhead on the outer closure member adjacent the opening.

11. The child resistant closure set forth in claim 9 wherein said at least one lug on said inner closure member is triangular in cross section and said axial and radial surfaces thereon extend generally radially.

* * * * *